US008434412B2

(12) United States Patent
Regebro

(10) Patent No.: US 8,434,412 B2
(45) Date of Patent: May 7, 2013

(54) LAUNCHABLE UNIT

(75) Inventor: Christer Regebro, Eskilstuna (SE)

(73) Assignee: SAAB AB, Linköping (SE)

( * ) Notice: Subject to any disclaimer, the term of this patent is extended or adjusted under 35 U.S.C. 154(b) by 438 days.

(21) Appl. No.: 12/492,235

(22) Filed: Jun. 26, 2009

(65) Prior Publication Data

US 2010/0018428 A1 Jan. 28, 2010

(30) Foreign Application Priority Data

Jun. 26, 2008 (EP) ..... 08445023

(51) Int. Cl.
*F42B 12/02* (2006.01)

(52) U.S. Cl.
USPC ..... 102/501; 89/1.11

(58) Field of Classification Search ..... 102/214, 102/305–307, 309, 210, 501; 89/1.11
See application file for complete search history.

(56) References Cited

U.S. PATENT DOCUMENTS

| | | | | |
|---|---|---|---|---|
| 4,015,355 | A * | 4/1977 | Schiessl et al. | 42/105 |
| 4,215,630 | A * | 8/1980 | Hagelberg et al. | 89/1.11 |
| 4,232,609 | A * | 11/1980 | Held | 102/214 |
| 4,237,789 | A * | 12/1980 | Stauers et al. | 102/270 |
| 4,359,943 | A * | 11/1982 | Majerus | 102/309 |
| 5,192,827 | A * | 3/1993 | Jasper, Jr. | 89/1.11 |
| 5,251,550 | A | 10/1993 | Grossler et al. | |
| 6,477,932 | B2 * | 11/2002 | Jung | 89/1.11 |
| 6,679,179 | B1 | 1/2004 | Bohl et al. | |
| 6,758,143 | B2 * | 7/2004 | Ritman et al. | 102/476 |
| 7,754,036 | B1 * | 7/2010 | Newman et al. | 149/38 |

FOREIGN PATENT DOCUMENTS

| | | | |
|---|---|---|---|
| DE | 3528338 | C1 | 1/1993 |
| DE | 19528112 | C1 | 12/1996 |
| DE | 1991652 | A1 | 7/2003 |
| EP | 1484573 | A1 | 12/2004 |

OTHER PUBLICATIONS

European Search Report—Dec. 15, 2008.

* cited by examiner

*Primary Examiner* — Michael Carone
*Assistant Examiner* — Reginald Tillman, Jr.
(74) *Attorney, Agent, or Firm* — Venable LLP; Eric J. Franklin

(57) ABSTRACT

A launchable unit including a warhead for generating non-nuclear electro magnetic pulses and a thermobaric warhead without dangerous fragments. The warheads in combination are arranged to operate in different modes dependent on target types and/or objectives with engagement controlled by the aiming and setting of the weapon by a gunner.

9 Claims, 2 Drawing Sheets

LAUNCHABLE UNIT

CROSS-REFERENCE TO RELATED APPLICATIONS

This application claims priority to European patent application 08445023.8 filed 26 Jun. 2008.

FIELD OF THE INVENTION

The present invention relates to a launchable unit, such as a shell or the like for use in a weapon, comprising a warhead for generating non-nuclear electro magnetic pulses.

BACKGROUND OF THE INVENTION

Launchable units comprising warheads for generation of non-nuclear electro magnetic pulses are previously known form for example DE 195 28 112 C1. Such launchable units are used to combat electronic equipments avoiding lethal effects. However, a weapon using such a launchable unit has a rather limited application field often requiring that also other types of warheads are available.

It is now and for the future a demand for new weapons that can be used for many different purposes from very limited non-lethal effects to full effect in surface and point like targets. The limitation may refer to affecting a particular area leaving for example the area around a combated point target unaffected, to a special type of material such as electronic equipments, or to non-lethal effects on for example a crowd of people in riot situations. Such weapons are inter alia suitable for use in connection to military peace efforts and when combating in urban terrain.

Furthermore, many ammunition kinds, one for every type of situation or purpose of firing, result in that the soldier has to carry an often unacceptable weight and there is also a risk that he chooses the wrong ammunition. So if the chosen kind of ammunition is too limited, his units may get into dangerous situations lacking adequate ammunition.

SUMMARY OF THE INVENTION

The object of the invention is to obtain a launchable unit offering the possibility to create a plurality of effects for different operating modes by means of the same launchable unit at the same time as the weight of the carried weight is kept down.

The object of the invention is obtain by a launchable unit characterized in that the launchable unit in addition to the warhead for generation of non-nuclear electro magnetic pulses comprises a thermobaric warhead without dangerous fragments, and that the comprised warheads in combination are arranged to operate in different modes dependent on target types and/or objectives with engagement controlled by the aiming and setting of the weapon by the gunner.

By combining a thermobaric warhead with a warhead for generating non-nuclear electromagnetic pulses under the control of a gunner, a graduated or eligible effect on the target as well as surrounding non-combatants from the launchable unit is obtained. The proposed launchable unit involves a reduction of ammunition types to be used. Furthermore, a change between different warhead attack modes can be carried out fast. A number of possible modes are discussed below.

According to a first mode the launchable unit is fired to burst about 10-20 meters above the target. In this case there is only a non-nuclear effect at the target. Such a mode is suitable for use when it is desired to combat for example vehicles, electronics, communication equipments and sensor activated protection systems without lethal effect.

According to a second mode the launchable unit is fired to burst about 5 to 10 meters above the target. This results in a strong and extended pressure pulse very unpleasant and functional disturbing to people. Facing the risks of further firing, an upset crowd of people will scatter. Lowering the height of burst further will temporary put people out of action. A still closer burst will cause lethal effect in point targets. This could be used against troops performing terror firing or against snipers.

According to a third mode the launchable unit is fired to burst as close as possible to the target. In this case the pressure and the non-nuclear electro magnetic pulse set the manoeuvrability out of order of vehicles, for example a helicopter resulting in that the helicopter crashes to the ground and thus the mode is likely to be lethal to the crew.

According to a third mode the launchable unit is fired with impact attack in the target or through window openings. In this case the blast and pressure effects destroy the target. A direct effect is obtained in point targets and in targets inside buildings. There is no non-nuclear electro magnetic pulse effect in this case because the components generating this effect are crushed before set in operation. The effect is delimited to the room attacked and possibly any closely situated space.

According to a favourable development of the launchable unit the warhead for generating non-nuclear electro magnetic pulses is located in the front of the launchable unit. By such a location it is often easy to cover an area to be subjected to non-nuclear pulses at the same time as the thermobaric warhead participate in the non-nuclear electro magnetic pulse generation.

According to another favourable development the warhead for generating non-nuclear electro magnetic pulses comprises piezo foils, electronics and antennas. When subjected to a plane front wave from the thermobaric warhead these foils generate a direct current pulse that can be further processed to create a non-nuclear electro magnetic pulse sent out by the antennas.

According to still another development the thermobaric warhead is located behind the warhead for generating non-nuclear magnetic pulses. This location facilitates the cooperation with the warhead for generation of non-nuclear electro magnetic pulses.

According to yet another development the thermobaric warhead comprises a blasting explosive and a wave front shaper surrounded by the blasting explosive. The wave front shaper ensures that an essentially plane shock wave for cooperation with the warhead for generating non nuclear electro magnetic pulses is generated.

Advantageously the launchable unit comprises a non-fragmenting envelope. The fragment proof envelope prevents people around area from being seriously injurious or lethal in a non lethal mode.

The setting of the launchable unit is according to a proposed embodiment enabled by providing a programmable fuse to be controlled by the gunner. In a straight forward solution the time from launching to activation of the thermobaric warhead is set by programming the fuse.

Preferably the warhead generating non-nuclear electro magnetic pulses generates pulses within the micro wave frequency range.

The launchable unit is proposed to be stabilized either by a design setting the unit in rotation or by providing the launchable unit with fins. The choice of stabilization method is up to the weapon designer. For example rotation stabilization could preferably be used for reusable weapons while fin stabilization could be preferred for disposable launchers.

BRIEF DESCRIPTION OF THE DRAWINGS

The invention will now be described in more detail by means of an embodiment with reference to the accompanying drawing in which.

DETAILED DESCRIPTION OF EMBODIMENTS OF THE INVENTION

Figure 1:
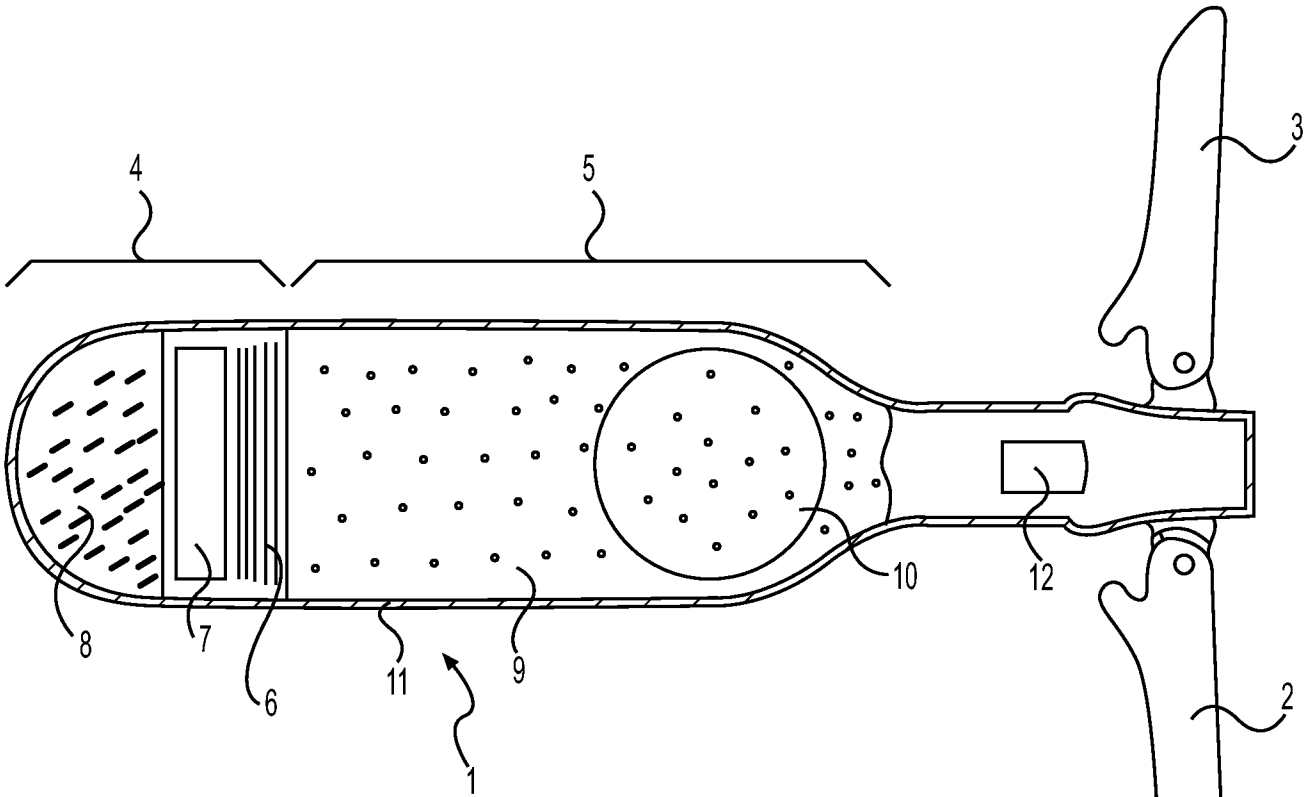
FIG. 1 shows a launchable unit in the shape of a shell in accordance with the invention.
Figure 2:
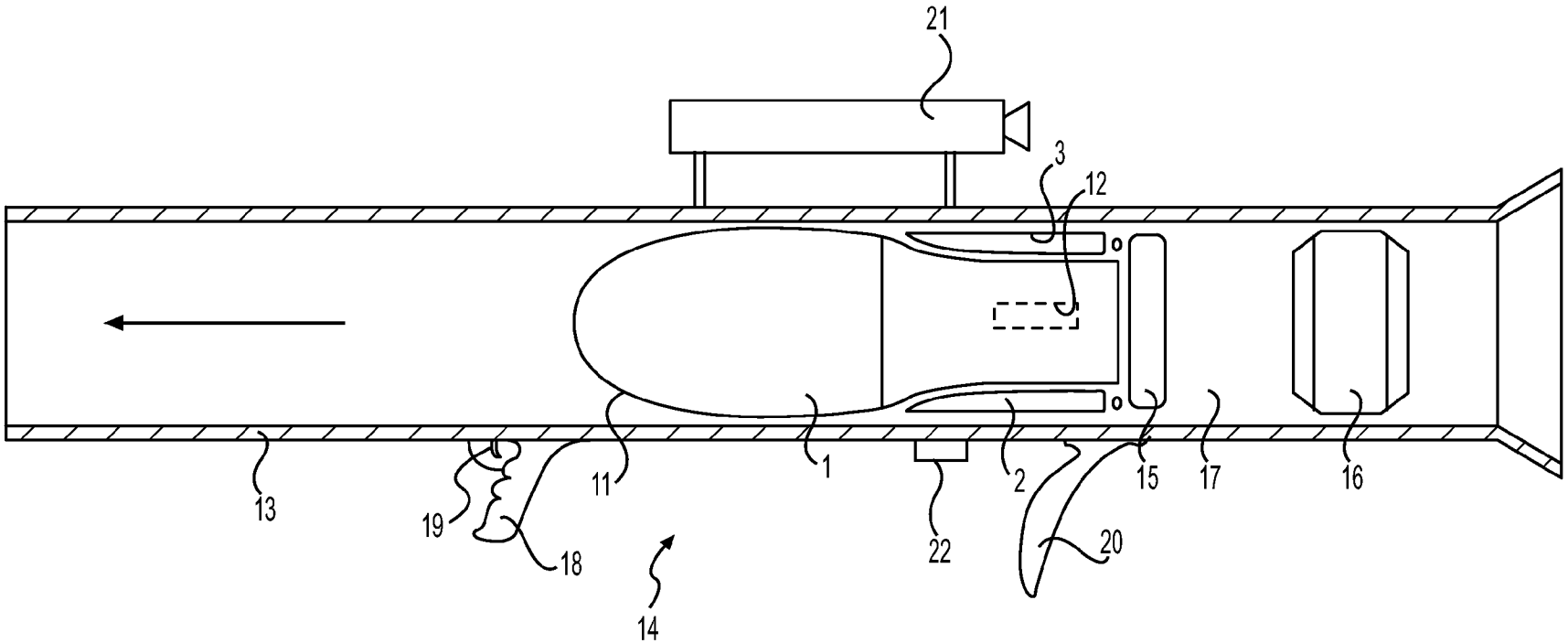
FIG. 2 schematically shows a weapon comprising a launchable unit in accordance with the invention.

In FIG. 1 a shell 1 is shown. This shell 1 is fired from the launcher tube of a weapon. An example of such a weapon is schematically shown in FIG. 2. For example, weapons on the market such as weapons known under the name of Carl Gustaf or AT4CS could be modified with a shell according to the invention. The shown shell has fins 2 and 3 used to stabilize the shell during its flight. As an alternative the stabilization can be obtained by rotation. The shell 1 is provided with two integrated warheads 4, 5.

The warhead 4 in the front of the shell is designed to generate non-nuclear electro magnetic pulses, often abbreviated NN-EMP. The warhead 4 comprises a bundle of piezo foils 6, electronics 7 and antennas 8. The warhead 5 located behind the warhead 4 is a thermobaric warhead comprising a blasting explosive 9 enclosing a wave front shaper 10. The warheads 4, 5 are surrounded by a fragment proof envelope 11. In the rear section of the shell 1 there is located a programmable fuse 12.

In FIG. 2, partly sectioned, the shell I is shown within the launcher tube 13 of a countermass weapon 14. Corresponding references has been given the same reference numbers as used with reference to FIG. 1. In addition to the shell 1 there is shown a propellant charge 15 and a countermass 16 separated by a pressure chamber 17 within the launcher tube 13. The operation of such a countermass weapon is well known and will not be further described here. On the outside of the launcher tube 13 a front grip 18 with a trigger 19 is provided. Furthermore a shoulder piece 20 and a sight arrangement 21 are indicated. There is also provided a device 22 for programming the fuse 12 of the shell. The device can be based on a mechanical switching operation transferred to the programmable fuse 12 mechanically, by magnetism, electronically or otherwise.

The shell operates as follows. In connection with the firing of the shell 1 from the launcher tube of a weapon 14, the gunner has the possibility to set the time to burst by programming the programmable fuse 12 via the device 22 for programming. Preferably after a predetermined time set by the gunner, the fuse activates the blasting explosive 9 of the warhead 5. In cooperation with the wave front shaper 10, the blasting explosive 9 generates a plane shock wave directed towards the bundle of piezo electric foils 6. When the plane shock wave hits the bundle of piezo electric foils, a direct current pulse with long duration is generated. The long duration is due to the fact that it takes some time for the shock wave to pass through the complete bundle. The pressures towards the bundle of piezo electric foils are very high and high energy is generated. The generated pulse collapses when burning through takes place in the foils but can also be limited by spark-overs. In order to obtain a maximum effect, the front of the shock wave must be as plane as possible to avoid that spark-overs locally takes place at an early stage. Accordingly, it is the task of the wave front shaper to straighten up the plane of the shock wave maximally. The generated direct current pulse is not used directly, but by means of the electronics 7 a superposed alternating current having very high frequency is generated. This generated alternating current is sent as a broadband pulse directly to the antennas 8 resulting in that a non-nuclear electro magnetic pulse is transmitted. Such a transmitted pulse covers a very wide frequency range just limited by the capacity of the antenna. The pulse can also be transmitted in a narrow frequency band. The effect within this band will then be higher and directed against the targets more sensitive components. Such a device is sometimes called a High Power Microwave (HMP) generator.

When the thermobaric warhead 5 is activated it also generates a thermobaric effect around the shell essentially caused by the secondary detonation/burning of the blast explosive residues rich in fuel 9. The envelope 11 surrounding the warheads is fragment proof and due to that does not add essentially any harmful effect when the blasting explosive is detonated.

The embodiment described above refers to a shell. It is however easy and within the scope of the invention to modify the weapon for other types of launchable units. It is also possible to replace the described embodiment for generation of non-nuclear electro magnetic pulses with other suitable embodiments for generation of non-nuclear electro magnetic pulses.

The invention claimed is:

1. A launchable unit, comprising:

a warhead for generating non-nuclear electronic component combating electromagnetic pulses, wherein the warhead for generating non-nuclear electronic component combating electromagnetic pulses comprises piezo foils, electronics and antennas;

a fragment proof envelope; and a thermobaric warhead comprising a blasting explosive and a wave front shaper surrounded by the blasting explosive, the thermobaric warhead being configured to generate a shock wave directed toward the nuclear electronic component to generate non-nuclear electronic component combating electromagnetic pulses, the thermobaric warhead being further configured to generate a thermobaric effect around the launchable unit without generating fragments, wherein the warhead for generating non-nuclear electromagnetic pulses and the thermobaric warhead are arranged to operate in different modes dependent on target types and/or objectives with engagement controlled by the aiming and setting of the launchable unit by a gunner, wherein the different modes include setting the warhead for generating non-nuclear electronic component combating electromagnetic pulses and the thermobaric warhead.

2. The launchable unit according to claim 1, wherein the warhead for generating non-nuclear electronic component combating electromagnetic pulses is located in a front of the launchable unit.

3. The launchable unit according to claim 1, wherein the thermo baric warhead is located behind the warhead for generating nonnuclear electronic component combating electromagnetic pulses.

4. The launchable unit according to claim 1, further comprising:

a programmable fuse.

5. The launchable unit according to claim 4, wherein a time from launching to activation of the thermo baric warhead is set by programming of the fuse.

6. The launchable unit according to claim 1, wherein the warhead generating non-nuclear electronic component combating electromagnetic pulses generates pulses within a micro wave frequency range.

7. The launchable unit according to claim 1, wherein the launchable unit is designed to rotate for stabilizing.

8. The launchalbe unit according to claim 1, further comprising:

fins for stabilizing.

9. The launchable unit according to claim 1, wherein the launchable unit comprises a shell.

* * * * *